US007347462B2

(12) United States Patent
Ellis et al.

(10) Patent No.: US 7,347,462 B2
(45) Date of Patent: Mar. 25, 2008

(54) DOOR HANDLE ASSEMBLY INCLUDING AUXILIARY BEARING AND AUXILIARY BEARING SUPPORT FOR A DOOR HANDLE

(75) Inventors: Philip C. Ellis, Sinking Spring, PA (US); David Allan Ebert, Schwenksville, PA (US)

(73) Assignee: Newfrey, LLC, Newark, DE (US)

( * ) Notice: Subject to any disclaimer, the term of this patent is extended or adjusted under 35 U.S.C. 154(b) by 84 days.

(21) Appl. No.: 11/099,375

(22) Filed: Apr. 5, 2005

(65) Prior Publication Data

US 2006/0220397 A1 Oct. 5, 2006

(51) Int. Cl.
*E05B 3/00* (2006.01)
*E05B 1/00* (2006.01)

(52) U.S. Cl. ..... 292/348; 292/336.3; 292/347; 70/224

(58) Field of Classification Search ..... 292/336.3, 292/347, 348, 356, 357, DIG. 53, DIG. 54; 70/224, 452
See application file for complete search history.

(56) References Cited

U.S. PATENT DOCUMENTS

| | | | | | |
|---|---|---|---|---|---|
| 1,462,827 | A * | 7/1923 | Rixson | 292/348 |
| 2,356,658 | A * | 8/1944 | Dean | 292/356 |
| 2,461,085 | A * | 2/1949 | Roy | 292/347 |
| 2,472,730 | A * | 6/1949 | Smith | 292/169.23 |
| 2,702,720 | A * | 2/1955 | Young | 292/357 |
| 2,805,880 | A * | 9/1957 | Brozek et al. | 292/357 |
| 2,846,255 | A * | 8/1958 | Wardwell, Jr. | 292/169.22 |
| 2,947,561 | A * | 8/1960 | Holden | 292/347 |
| 2,967,728 | A * | 1/1961 | Falk | 292/347 |
| 3,471,190 | A * | 10/1969 | Turnbull et al. | 292/356 |
| 4,042,268 | A | 8/1977 | Coglan | 292/347 |
| 4,067,599 | A * | 1/1978 | Ohno | 292/356 |
| 4,405,164 | A | 9/1983 | Lint et al. | 292/169.21 |
| 4,784,418 | A | 11/1988 | Pearson et al. | 292/348 |
| 5,067,758 | A | 11/1991 | Fann et al. | 292/347 |
| 5,960,517 | A | 10/1999 | Sprekeler | 16/121 |
| 6,322,113 | B1 | 11/2001 | Ayers et al. | 292/336.3 |
| 6,386,602 | B1 * | 5/2002 | Lan | 292/336.3 |
| 6,695,365 | B2 * | 2/2004 | Chong et al. | 292/348 |
| 6,993,945 | B1 * | 2/2006 | Chen | 70/472 |
| 6,997,024 | B2 * | 2/2006 | Etlicher | 70/210 |
| 7,066,507 | B2 * | 6/2006 | Don | 292/336.3 |
| 7,077,437 | B2 * | 7/2006 | Huang | 292/336.3 |
| 2003/0011201 | A1 * | 1/2003 | Rodriguez et al. | 292/336.3 |
| 2003/0155781 | A1 * | 8/2003 | Bui et al. | 292/357 |

FOREIGN PATENT DOCUMENTS

| | | |
|---|---|---|
| EP | 192848 | * 12/1985 |
| GB | 2194139 | * 3/1988 |

* cited by examiner

*Primary Examiner*—Carlos Lugo
(74) *Attorney, Agent, or Firm*—Richard J. Veltman, Esq.; Taylor & Aust, P.C.; Ronald K. Aust, Esq.

(57) ABSTRACT

A door handle assembly includes a door handle having an operator portion, and a shank extending from the operator portion. A mounting plate has a first bearing, the first bearing being sized to receive the shank of the door handle. An auxiliary bearing assembly includes an auxiliary bearing support and a second bearing. The auxiliary bearing support is connected to the mounting plate, wherein the second bearing is spaced apart a distance from the first bearing along an axis passing through the first bearing and the second bearing, the second bearing being sized to receive the shank of the door handle.

8 Claims, 3 Drawing Sheets

DOOR HANDLE ASSEMBLY INCLUDING AUXILIARY BEARING AND AUXILIARY BEARING SUPPORT FOR A DOOR HANDLE

BACKGROUND OF THE INVENTION

1. Field of the Invention

The present invention relates to door hardware, and, more particularly, to a door handle assembly including an auxiliary bearing and auxiliary bearing support for a door handle.

2. Description of the Related Art

Door handle sets have long been available that include a door handle, e.g., knob or lever, that is rotatably supported by an escutcheon, and retained thereto using a fastener, such as a snap ring. The door handle includes, for example, an operator portion and a shank. The escutcheon includes an opening defining a bearing having a single contact bearing surface for receiving the shank of the door handle. The bearing clearance between the shank of the door handle and the bearing surface of the escutcheon results in play, or wobble, of the door handle with respect to the escutcheon.

What is needed in the art is a mechanism to reduce or eliminate the play, or wobble, of the door handle with respect to the escutcheon.

SUMMARY OF THE INVENTION

The present invention provides an apparatus and method to reduce or eliminate the play, or wobble, of the door handle with respect to a mounting plate, such as an escutcheon.

The invention, in one form thereof, relates to a door handle assembly that includes a door handle having an operator portion, and a shank extending from the operator portion. A mounting plate has a first bearing, the first bearing being sized to receive the shank of the door handle. An auxiliary bearing assembly includes an auxiliary bearing support and a second bearing. The auxiliary bearing support is connected to the mounting plate, wherein the second bearing is spaced apart a distance from the first bearing along an axis passing through the first bearing and the second bearing, the second bearing being sized to receive the shank of the door handle.

In another form thereof, the invention relates to a method of reducing play in a door handle in directions non-parallel to a rotational axis of the door handle, including establishing a first bearing in a mounting plate for receiving a shank of the door handle; spacing a second bearing for receiving the shank of the door handle a distance from the first bearing along the rotational axis; and inserting the shank of the door handle in the first bearing and the second bearing.

The invention, in another form thereof, relates to a method of assembling a door handle assembly having a mounting plate, including inserting a shank of a door handle through a primary bearing of the mounting plate and an auxiliary bearing of an auxiliary bearing assembly; and attaching the auxiliary bearing assembly to the mounting plate.

An advantage of the present invention is that play, i.e., wobble, of the door handle with respect to the mounting plate, e.g., escutcheon, in directions non-parallel to an axis of rotation of the door handle is reduced.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate one embodiment of the invention, in one form, and such exemplifications are not to be construed as limiting the scope of the invention in any manner.

DETAILED DESCRIPTION OF THE INVENTION

Figure 1:
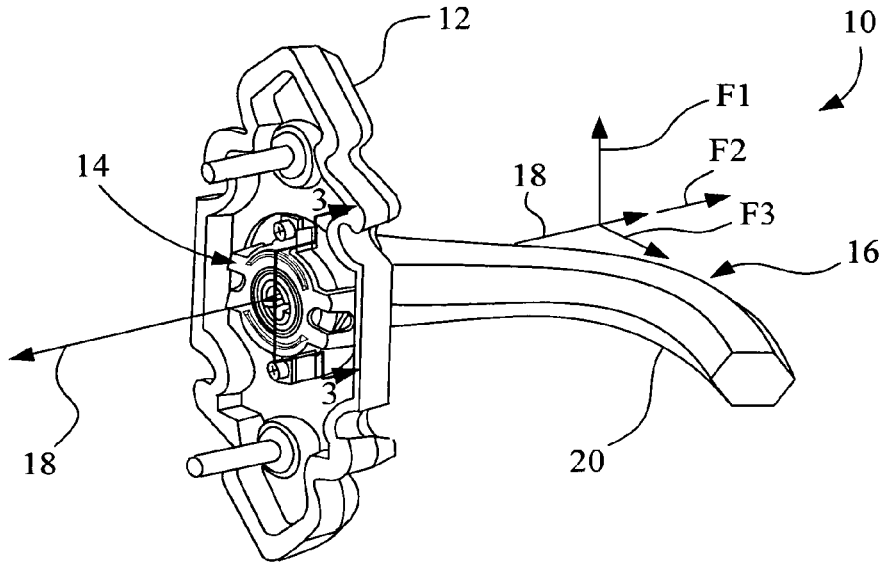
FIG. 1 is perspective view of a door handle assembly for mounting a door handle in accordance with the present invention.
Figure 2:
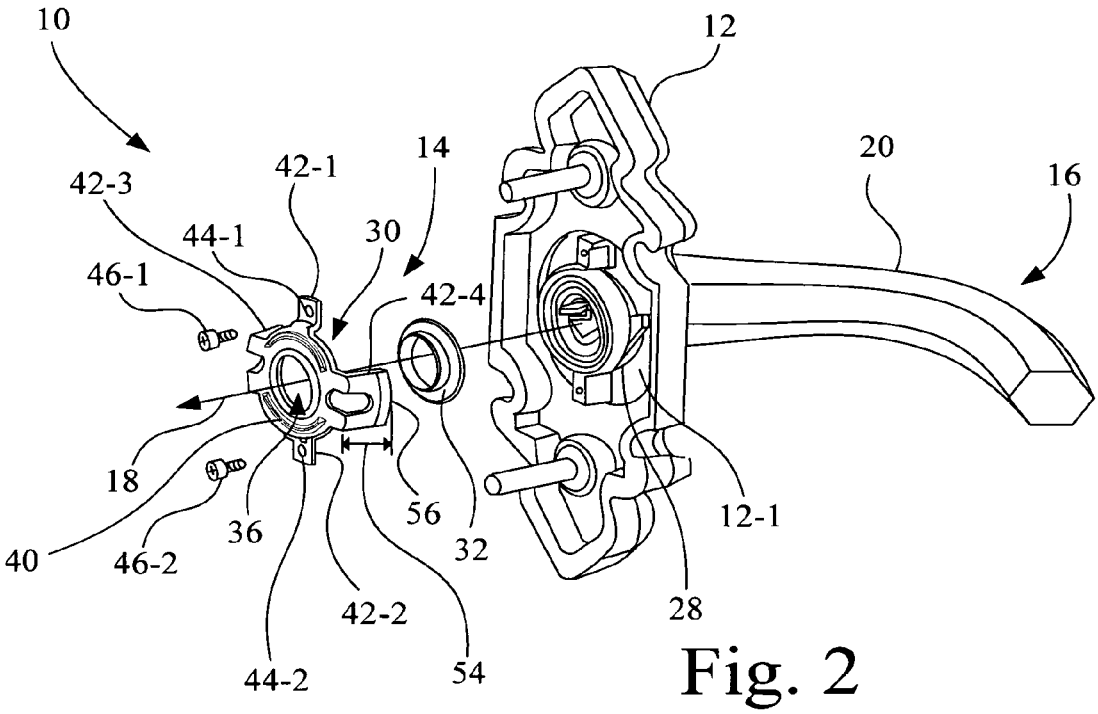
FIG. 2 is an exploded perspective view of the door handle assembly of FIG. 1.

Referring now to the drawings, and more particularly to FIGS. 1 and 2, there is shown a door handle assembly 10 embodying the present invention. Door handle assembly 10 includes, for example, a mounting plate 12, which may be in the form of an escutcheon; an auxiliary bearing assembly 14; and a door handle 16. An axis 18 serves as a rotational axis for door handle 16 with respect to mounting plate 12. Auxiliary bearing assembly 14 is configured to control, i.e., reduce, the amount of play, i.e., wobble, of door handle 16 in directions non-parallel to axis 18, i.e., the rotational axis of the door handle 16 with respect to mounting plate 12, and to distribute a torque load on mounting plate 12 resulting from forces applied to door handle 16. Such a torque load is represented in FIG. 1, for example, by a force having radial force components F1 and F3 extending from axis 18 in a direction non-parallel to axis 18.

Figure 3:
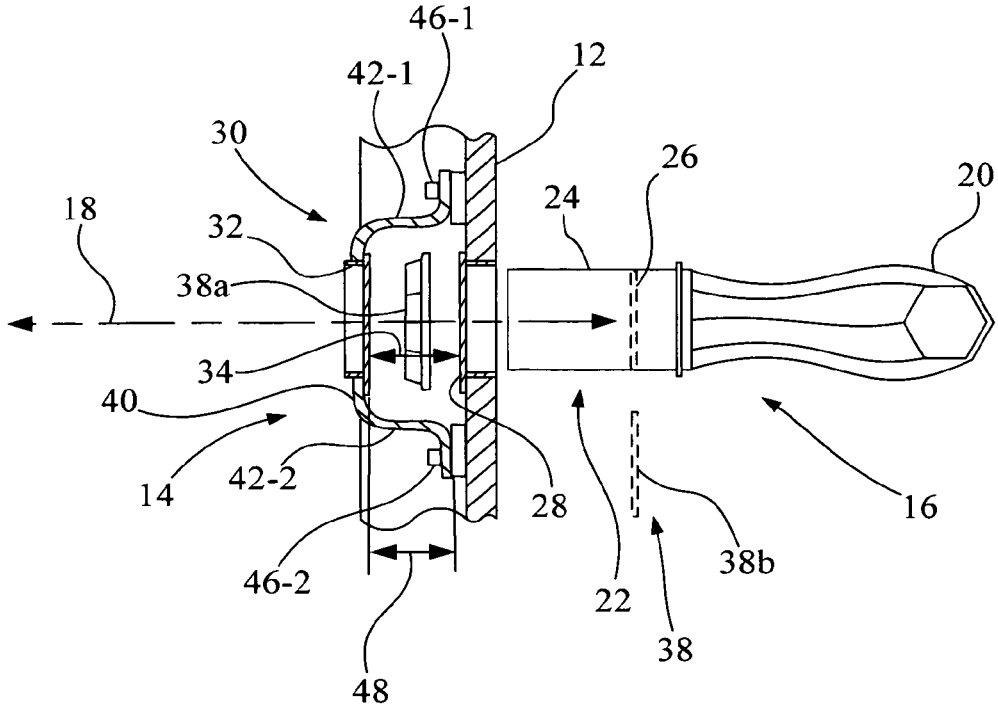
FIG. 3 is a sectioned side view of a portion of the door handle assembly of FIG. 1.

As shown in FIGS. 1-3, door handle 16 has an operator portion 20 and, as best seen in FIG. 3, a shank 22. Operator portion 20 is designed to be grasped by a user, and may be, for example, a knob or lever. Shank 22 extends from operator portion 20 and transfers a rotational force applied by the user to operation portion 20 to a mechanism (not shown), such as a door latch mechanism. Shank 22 extends along axis 18. Shank 22 includes a perimetrical surface 24. Perimetrical surface 24 may be, for example, a substantially cylindrical surface.

Mounting plate 12 includes a primary bearing 28. Primary bearing 28 may be, for example, in the form of a bushing that is secured directly to mounting plate 12, such as by being received in a press fit in an opening in mounting plate 12. Alternatively, primary bearing 28 may be formed integral with mounting plate 12. Primary bearing 28 is sized to slideably receive shank 22 of door handle 16. In the example where primary bearing 28 is a bushing, shank 22 of door handle 16 is received in primary bearing 28 such that perimetrical surface 24 engages primary bearing 28 in a snug, but rotatable, fit. Those skilled in the art will recognize, however, that other bearing types, such as a roller bearing or needle bearing, may be substituted for the bushing configuration.

Auxiliary bearing assembly 14 includes an auxiliary bearing support 30 and an auxiliary bearing 32. Auxiliary bearing support 30 is connected to mounting plate 12, wherein auxiliary bearing 32 is spaced apart a distance 34 from primary bearing 28 along axis 18, which passes through each of primary bearing 28 and auxiliary bearing 32, with primary bearing 28 being axially aligned with auxiliary bearing 32.

Auxiliary bearing 32 may be, for example, in the form of a bushing that is secured directly to auxiliary bearing support 30, such as by being received in a press fit in an opening 36 in auxiliary bearing support 30. Alternatively, auxiliary bearing 32 may be formed integral with auxiliary bearing support 30. Auxiliary bearing 32 is sized to slideably receive shank 22 of door handle 16. In the example where auxiliary bearing 32 is a bushing, shank 22 of door handle 16 is received in auxiliary bearing 32, such that perimetrical surface 24 engages auxiliary bearing 32 in a snug, but rotatable, fit. Those skilled in the art will recognize, however, that other bearing types, such as a roller bearing or needle bearing, may be substituted for the bushing configuration.

Referring to FIG. 3, door handle assembly 10 further includes a retaining device 38 to retain shank 22 in primary bearing 28 and auxiliary bearing 32 when acted upon by a force including an axial force component F2 along axis 18 (see FIG. 1). Thus, retaining device 38 restrains movement of door handle 16 in the direction of force component F2, and retains door handle 16 in a mounting relationship with mounting plate 12. Retaining device 38 may be any suitable device that may be used to restrain the axial movement of shank 22 with respect to bearings 28, 32. Retaining device 38, may be, for example, a push retainer 38*a*, or as one alternative, as shown by dashed lines in FIG. 3, may be a snap ring 38*b* that engages a groove 26 formed in perimetrical surface 24. As a further alternative, for example, retaining device 38 may be a fastener, such as a threaded nut.

Figure 4:
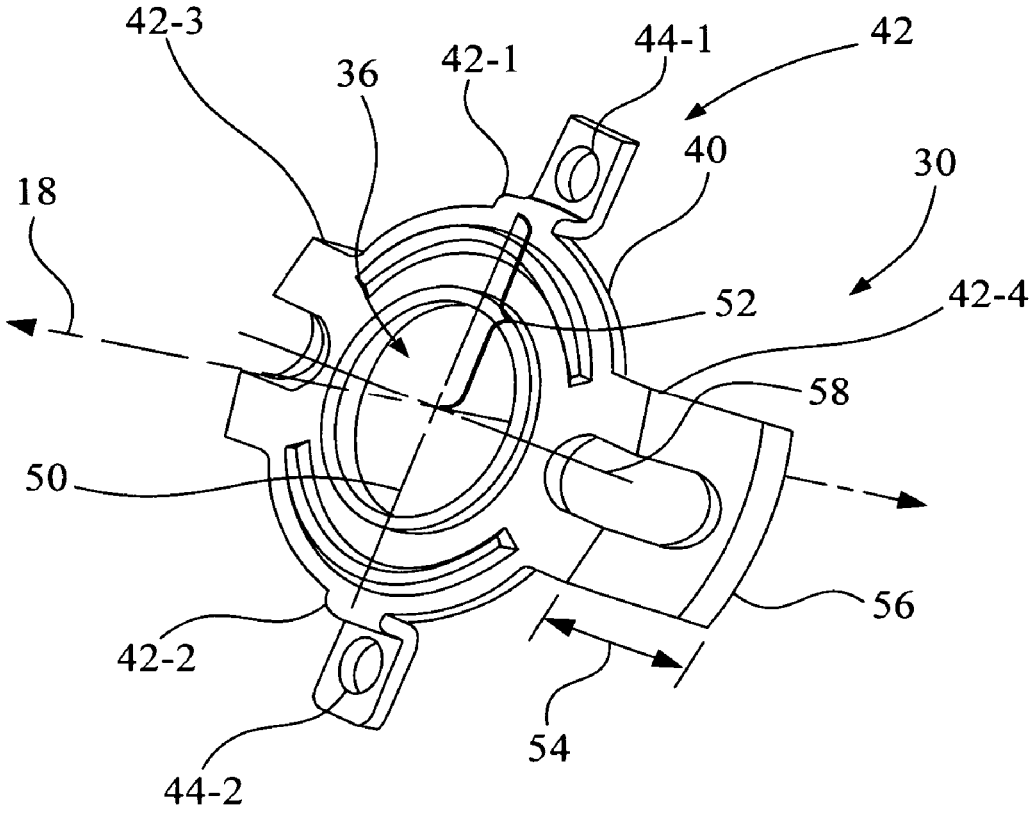
FIG. 4 is a perspective view of the auxiliary bearing support of the door handle assembly of FIG. 1.

Referring now also to FIG. 4, auxiliary bearing support 30 includes a body 40 and a plurality of legs 42. In the exemplary embodiment of auxiliary bearing support 30 shown in FIGS. 1-4, primary mounting legs 42-1 and 42-2 include respective openings 44-1 and 44-2 for receiving fasteners 46-1, 46-2 (see FIG. 2), with each of legs 42-1, 42-2 being attached to mounting plate 12 by respective fasteners 46-1, 46-2. As shown in FIG. 3, a length 48 of legs 42-1, 42-2, extends parallel axis 18, and determines the distance 34 between primary bearing 28 of mounting plate 12 and auxiliary bearing 32 of auxiliary bearing support 30. Legs 42-1, 42-2 are positioned to distribute the torque load on mounting plate 12 exerted by a force having radial force component F1 (positive or negative) generally exerted in a direction non-parallel to axis 18, as shown in FIG. 1.

In the embodiment shown, referring to FIG. 4, legs 42-1 and 42-2 are diametrically opposed with respect to line 50, which is orthogonal to axis 18. Further, legs 42-1, 42-2 are located at a radial distance 52 from axis 18 that passing through opening 36, and in turn, auxiliary bearing 32.

Auxiliary bearing support 30 further includes secondary legs 42-3, 42-4 located at a radial distance, such as radial distance 52, from axis 18. Each secondary leg 42-3, 42-4 has a length 54, and defines a tab end 56 that engages a surface 12-1 of mounting plate 12. As shown, tab end 56 is not fastened to mounting plate 12. In the embodiment shown, referring to FIG. 4, secondary legs 42-3 and 42-4 are diametrically opposed with respect to line 58, which is orthogonal to axis 18. Each secondary leg 42-3, 42-4 is angularly offset about axis 18 from mounting legs 42-1, 42-2. In the embodiment shown, secondary legs 42-3, 42-4 may be arranged in relation to primary legs 42-1, 42-2 such that line 58 is orthogonal to line 50. Secondary legs 42-3, 42-4 are positioned to distribute the torque load on mounting plate 12 exerted by a force having a radial force component F3 (positive or negative) generally exerted in a direction non-parallel to axis 18, and substantially orthogonal to radial force component F1.

In one method of assembling the door handle assembly 10 of the present invention, auxiliary bearing assembly 14 is loosely attaching to mounting plate 12 using fasteners 46-1, 46-2. Then, shank 22 is inserted through primary bearing 28 and auxiliary bearing 32. Operator portion 20 of door handle 16 is rotated clockwise and counterclockwise to align bearings 28, 32 along axis 18, and fasteners 46-1, 46-2 are tightened. Retaining device 38 may be installed on shank 22 at any convenient time during the assembly process, as may be determined by the exact configuration of door handle assembly 10.

Some of the assembly steps described above may be varied from the particular order as described. For example, door handle 16 may be secured to mounting plate 12 by retaining device 38 prior to attachment of auxiliary bearing assembly 14 to mounting plate 12, or alternatively, may be secured after attachment of auxiliary bearing assembly 14 to mounting plate 12.

While this invention has been described with respect to one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of reducing play in a door handle in directions non-parallel to a rotational axis of said door handle, comprising:

establishing a first bearing in a mounting plate for receiving a shank of said door handle;

establishing an auxiliary bearing support having a plurality of legs;

mounting a second bearing for receiving said shank of said door handle to said auxiliary bearing support;

positioning said plurality of legs of said auxiliary bearing support against said mounting plate for spacing said second bearing a distance from said first bearing along said rotational axis;

attaching said auxiliary bearing support to said mounting plate; and inserting said shank of said door handle in said first bearing and said second bearing.

2. The method of claim 1, wherein said auxiliary bearing support and said second bearing are formed as an integral one-piece unit.

3. The method of claim 1, further comprising installing a retaining device on said shank to secure said door handle to said mounting plate.

4. A method of assembling a door handle assembly having a mounting plate, comprising:

inserting a shank of a door handle through a primary bearing of said mounting plate and an auxiliary bearing of an auxiliary bearing assembly having a plurality of legs; and attaching a portion of said plurality of legs of said auxiliary bearing assembly to said mounting plate.

5. The method of claim 4, wherein said auxiliary bearing assembly is first loosely attached to said mounting plate using fasteners, the method further comprising:

then aligning said primary bearing and said auxiliary bearing and inserting said shank of said door handle through said primary bearing of said mounting plate and said auxiliary bearing of an auxiliary bearing assembly; and then tightening said fasteners.

6. The method of claim 4, further comprising installing a retaining device to restrain movement of said door handle axially along a rotational axis passing through said shank with respect to said mounting plate.

7. The method of claim 6, wherein said door handle is secured to said mounting plate by said retaining device prior to attachment of said auxiliary bearing assembly to said mounting plate.

8. The method of claim 4, wherein the step of inserting said shank of said door handle through said primary bearing of said mounting plate and said auxiliary bearing of said auxiliary bearing assembly precedes the step of attaching said auxiliary bearing assembly to said mounting plate.

* * * * *